United States Patent [19]

Provence et al.

[11] Patent Number: 5,052,710

[45] Date of Patent: Oct. 1, 1991

[54] HINGE TYPE CROSS-COUNTRY SKI BINDING

[75] Inventors: Marc Provence, Thorens-les-Glieres; Gerard Graillat, Annecy, both of France

[73] Assignee: Salomon S.A., Annecy Cedex, France

[21] Appl. No.: 388,497

[22] Filed: Aug. 2, 1989

[30] Foreign Application Priority Data

Aug. 16, 1988 [FR] France ..... 88 11104

[51] Int. Cl.[5] ..... A63C 9/20

[52] U.S. Cl. ..... 280/615

[58] Field of Search ..... 280/615, 614, 627, 631

[56] References Cited

U.S. PATENT DOCUMENTS

| | | | |
|---|---|---|---|
| 2,072,477 | 3/1937 | Dodd | 280/614 |
| 2,614,858 | 10/1952 | Pierce, Jr. | 280/627 |
| 4,309,833 | 1/1982 | Salomon | 280/615 |
| 4,382,611 | 5/1983 | Salomon | 280/615 |
| 4,562,653 | 1/1986 | Salomon | 280/615 |
| 4,647,064 | 3/1987 | Salomon et al. | 280/615 |
| 4,768,804 | 9/1988 | With | 280/614 |
| 4,844,503 | 7/1989 | Dunand | 280/615 |
| 4,887,832 | 12/1989 | Provence | 280/615 |

FOREIGN PATENT DOCUMENTS

| | | | |
|---|---|---|---|
| 0131234 | 1/1984 | European Pat. Off. | 280/615 |
| 2439602 | 5/1980 | France | 280/615 |
| 2582226 | 11/1986 | France | 280/615 |
| 8400498 | 2/1984 | World Int. Prop. O. | 280/614 |

*Primary Examiner*—David M. Mitchell

*Attorney, Agent, or Firm*—Sandler, Greenblum, & Bernstein

[57] ABSTRACT

Cross-country ski binding for a shoe or boot having a transverse journal axle. A fixed and movable jaw receive the journal axle and allow pivotal movement of the shoe or boot relative to the ski. A toggle or overcenter linkage both biases and latches the movable jaw in a closed position and guide the movable jaw in its movement relative to the fixed jaw.

10 Claims, 3 Drawing Sheets

HINGE TYPE CROSS-COUNTRY SKI BINDING

BACKGROUND OF THE INVENTION

1. Field of the Invention

The present invention relates to a binding of the hinge type for a shoe or boot having a transverse journal axis positioned in front thereof.

2. Description of Background and Relevant Information

A binding of the above type is described in French Patent No. 2,439,602 and shown in side view in FIG. 1. This binding includes two jaws 3, 4, which are adapted to latch the journal axle 2 of a shoe or boot 1 while allowing rotation of the shoe or boot (hereinafter referred to as a boot).

One of the jaws 3 is fixed, and forms a support element for axle 2 of the boot, while the other jaw 4 is supported by latching lever or pressure element 5, which is journalled on ski 7 by elastic mounting 6. Elastic mounting 6, which in this case is a U-shaped stirrup of spring wire, is journalled by its transverse arm at 9 on the ski and by each of its lateral arms at 8 on latching lever 5.

Latching lever 5 and elastic mounting 6 form a toggle or overcenter linkage having a dead center line D joining journal 9 and axle 2.

The latching of this known binding occurs by rotation of lever 5 towards the bottom, that is, in the counterclockwise direction, and vertical displacement of journal 8 to below dead center line D. The locking in the latched position automatically occurs from the time of passage over the dead center line of the overcenter device.

The rotation of lever 5, during the latching of the binding, moves movable jaw 4 against fixed jaw 3, to hold journal axle 2 between jaws 3 and 4, thereby ensuring holding of axle 2 while allowing rotation of the axle.

Jaws 3 and 4 form an elastically deformable bearing with movable jaw 4 being pressed in the direction of fixed jaw 3 by elastic mounting 6.

Such a construction permits automatic compensation of any play. In addition, it is very simple in construction since the same element, the latching lever 5, has both the function of locking axle 2 by jaw 4 and the elastic biasing of axle 2.

In this known binding, elastic mounting 6 of the lever not only exerts the latching force but also exerts a return force on the boot when the boot is lifted from the upper surface of the ski. This is a very simple construction, but significant forces are exerted on mounting 6 which is incompatible with the forces which can be exerted by the user for the latching or unlatching of the binding.

Furthermore, the bulkiness of the construction in front of the nose of the boot prevents the positioning of return means for the boot that is independent of the elastic mounting of the latching lever.

This known binding also has problems with correct placement of latching lever 5, and "flapping" of the lever when the binding is in the open position because of the total freedom of the pivotal mounting of the lever.

Moreover, guidance of the end of the lever cannot be obtained by a single construction because of overcenter linkage 6 and the necessary vertical displacement of journal 8 of the lever 5 and its mounting 6 to break the toggle of the overcenter linkage.

The above-mentioned problems have not been resolved in a satisfactory manner until the present invention, since the known binding of French Patent No. 2,439,602 has not been further developed, in spite of all its advantages.

SUMMARY OF THE INVENTION

The present invention relates to a cross-country ski binding for a shoe or boot having a transverse axle, including a fixed jaw and a movable jaw adapted to latch the axle while allowing rotation thereof. The movable jaw is displaceable in the direction of the fixed jaw, for securing the axle. A latching lever is journalled for movement about an axis on the movable jaw, and forms an overcenter linkage system. The axis on the movable jaw is a point defining a dead center line of the overcenter linkage system.

According to another aspect of the invention, guidance means are provided for the movable jaw, so that the movable jaw is only displaceable in the longitudinal direction. The movable jaw cooperates with the fixed jaw for guidance in the longitudinal direction. According to one embodiment, the fixed jaw includes a groove and the movable jaw includes an extension for cooperating with the groove for the guidance in the longitudinal direction.

The guidance means of the movable jaw may also include a longitudinal slot on one of the movable jaw or a fixed portion of the binding, and an associated axle on the other of the movable jaw and the fixed element of the binding which is adapted to slide in the slot.

According to another aspect of the invention, the movable jaw is secured to a carriage which is longitudinally displaceable with the guidance means being attached to the carriage. The guidance means of the movable carriage includes at least one longitudinal slot on the carriage, and an axle on a fixed part of the binding for cooperating with the slot. The axle is one of the axes of the overcenter linkage system.

The overcenter linkage system includes first and second links, the first link being connected at a first end to a fixed part of the binding, the second link being connected at a first end to the movable jaw, the connections at the first ends of the first and second link defining a dead center line of the overcenter linkage system, with the first and second links being pivotally connected to each other.

The overcenter linkage system comprises a lever connected at one end to a fixed portion of the binding and at the other end to the latching lever, the connection to the fixed portion of the binding and the connection to the latching lever, defining a dead center line of the overcenter linkage system.

According to another aspect of the invention, an elastic element on the movable jaw is adapted to exert a return force on the nose of the boot when the boot is lifted from the upper surface of the ski, and when the movable jaw is in a latched position.

According to another aspect of the invention, biasing means are provided for biasing the movable jaw in the direction of the fixed jaw.

The present invention further relates to a cross country ski binding for a shoe or boot having a transverse axle, and including a base, a fixed jaw, and a movable jaw being displaceable relative to the base towards the fixed jaw to a latched position and away from the fixed jaw to an unlatched position. The fixed jaw and the movable jaw are adapted to secure the transverse axle in the latched position. A latching lever is provided for displacing the movable jaw, and an overcenter linkage is connected at a first end to the base and at a second end to the latching lever.

The latching lever is pivotally connected to the movable jaw at a first joint, and the first end of the overcenter linkage is connected to the base at a second joint. A line between the first joint and the second joint defines a dead center line of the overcenter linkage.

The overcenter linkage comprises a U-shaped stirrup, which is formed from spring wire.

The overcenter linkage biases the movable jaw towards the fixed jaw, and includes a first link having a first and second end, the first end being connected to the base; a second link having a first and second end, the first end being connected to the movable jaw and the second end being connected to the second end of the first link; and a line between the connection of the first end of the first link to the base and the connection of the first end of the second link to the movable jaw defines a dead center line of the overcenter linkage. The latching lever is associated with the connection of the second end of the first link to the second end of the second link.

The binding further includes a movable carriage which is movable in relation to the base, the movable jaw being supported on the carriage.

According to another aspect of the invention, the binding includes a groove which is fixed in relation to the base, and an extension on the movable jaw which cooperates with the groove so that the movable jaw is guided in the longitudinal direction. Slots on the movable carriage also cooperate with a portion of the overcenter linkage for guiding the carriage in the longitudinal direction. The movable jaw is only movable in the longitudinal direction.

According to another aspect of the invention, an elastic bumper is mounted on the movable jaw for biasing the boot towards the ski.

BRIEF DESCRIPTION OF THE DRAWINGS

The invention is further explained from the description which follows with reference to the drawings illustrating, by way of non-limiting examples, three preferred embodiments of the invention wherein.

DETAILED DESCRIPTION OF THE PREFERRED EMBODIMENTS

An object of the present invention is to overcome the above-described disadvantages, and to provide a binding of the type including two jaws adapted to latch the journal axle of a boot while allowing the rotation thereof. One of the jaws is fixed and the other jaw is movable and able to be displaced and elastically biased in the direction of the fixed jaw for securing the journal axle by a toggle or overcenter latching system, where the problems of placement and positioning of the latching system are solved and it is possible to provide in the front of the nose of the boot a sufficient space for a return element for biasing the boot towards the ski, all while being reliable and relatively simple and inexpensive.

According to the invention, the movable jaw is journalled to the latching system and the journal axis is a journal axis of the overcenter linkage. By this arrangement, a separation of the functions of elastic biasing and latching is obtained, which facilitates the guidance of this system.

Preferably, the journal axis of the movable jaw constitutes one of the axes defining the dead center line of the overcenter linkage, which further simplifies and facilitates the guidance of the system.

The overcenter system can be formed from a U-shaped stirrup of elastic wire or by a system of journalled links.

Figure 1:
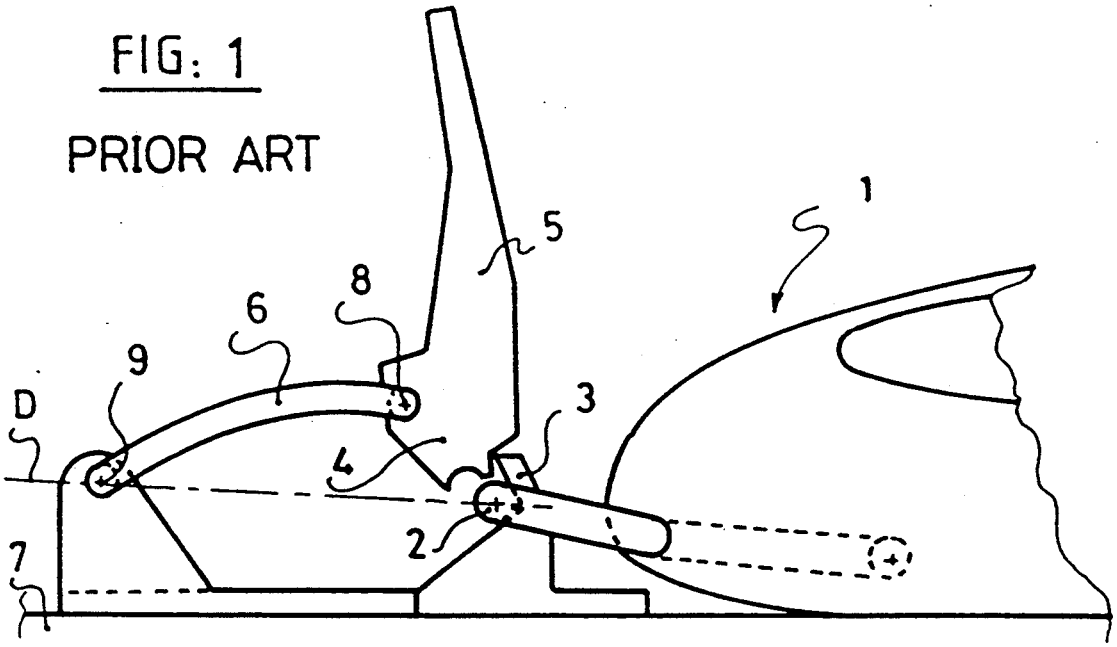
FIG: 1 PRIOR ART
FIG. 1 is a side view of a known binding.
Figure 2:
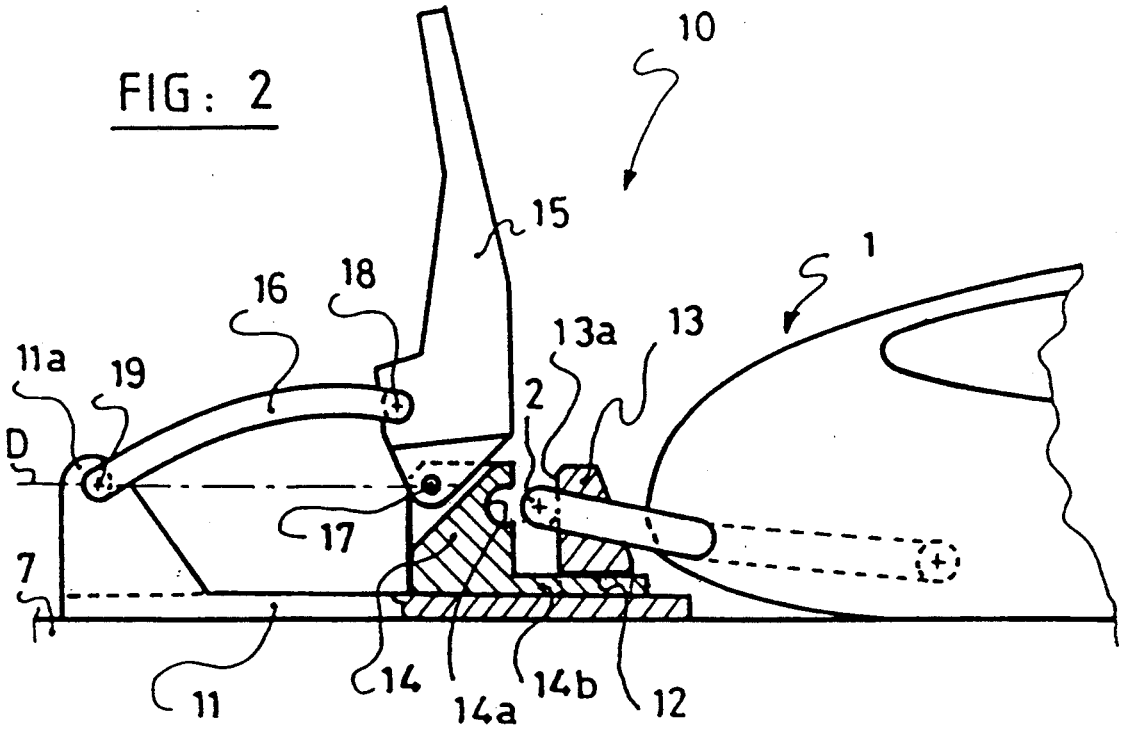
FIG. 2 is a side view in partial section of a binding according to a first embodiment.

Binding 10, according to the invention shown in FIG. 2, comprises base 11 adapted to be affixed to ski 7 and supporting support element 13, which extends vertically and constitutes the fixed jaw of the binding.

Support element 13 includes support surface 13*a*, which is substantially planar and vertical for engaging journal axle 2 of boot 1. This axle 2 is constituted by the transverse arm of a loop which is affixed to the front end of the boot. Support surface 13*a* can have any other shape and may particularly be a housing which is more or less accentuated for engaging journal axle 2.

The base also includes longitudinal guidance groove 12, which can be solidly affixed to jaw 13, as shown in FIG. 2.

The other element for locking journal axle 2 is movable jaw 14 which is journalled at 17 on latching lever 15. Movable jaw 14 is, in a known manner, adapted to cooperate with fixed jaw 13 to grip journal axle 2. Movable jaw 14 includes transverse housing 14*a* having a semicylindrical shape which is adapted to receive journal axle 2. Housing 14*a* can have another shape depending upon the geometry of journal axle 2 and of that of associated support surface 13*a* of fixed jaw 13. The essential requirement is that these two surfaces 13*a*, 14*a* cooperate to form a housing capable of receiving journal axle 2.

Movable jaw 14 comprises an extension 14*b* which is adapted to slide in groove 12 so as to permit the guidance of the movable jaw in the longitudinal direction. The movable jaw is displaceable only in the longitudinal direction.

Latching lever 15 is itself journalled on a segment 11*a* of base 11 by means of elastic mounting 16. Elastic mounting 16 is a U-shaped stirrup which is journalled by its transverse arm at 19 on base 11 and by ends 18 of its laterally spaced legs on latching lever 15.

Latching lever 15, elastic mounting 16, and movable jaw 14 form an overcenter linkage whose dead center line D is defined by the line joining points 19 and 17.

The locking of the overcenter linkage occurs by pivoting lever 15 in the counterclockwise direction so that point 18, of the lever with mounting 16 passes below dead center line D. The passage below the dead center line is accompanied by a longitudinal displacement of jaw 14 towards the rear of the ski (i.e. towards the right in the drawing), thus causing latching of axle 2.

According to the invention, since the functions of locking and elastic biasing of latching lever 15 is obtained by the described journalling of jaw 14 and lever 15, it is possible for the movable jaw to only move in the longitudinal direction. This simplified movement makes proper guidance which can be obtained by a single groove possible.

Furthermore, the integration of the journal axis of the movable jaw and the latching lever in an overcenter linkage system makes it possible to simplify the construction of the assembly by avoiding the multiplication of joints and to facilitate guidance.

The guidance of jaw 14 makes it possible at the same time to solve the problem of correct placement of the latching lever at the moment of positioning of the boot since the latching lever is no longer "flapping".

The guidance of the movable jaw allows it to have greater displacement, and consequently, a wider spacing from the fixed jaw for easier positioning of the journal axle of the boot between the two jaws.

It is noted that it is also possible for the displacement of the movable jaw to not only be in translation, but that the pure translation of movable jaw 14 is simpler to achieve and guide.

Of course, the latching of axle 2 of the boot obtained by means of the binding according to the invention, is exactly the same as that obtained by the binding of French Patent No. 2,439,602 described above, i.e., latching while allowing rotation of axle 2.

It is also noted that the journalling of movable jaw 14 on lever 15 makes it possible to free a space in the front of the nose of the boot for positioning a return element for biasing the boot when it pivots about axle 2.

Figure 3:
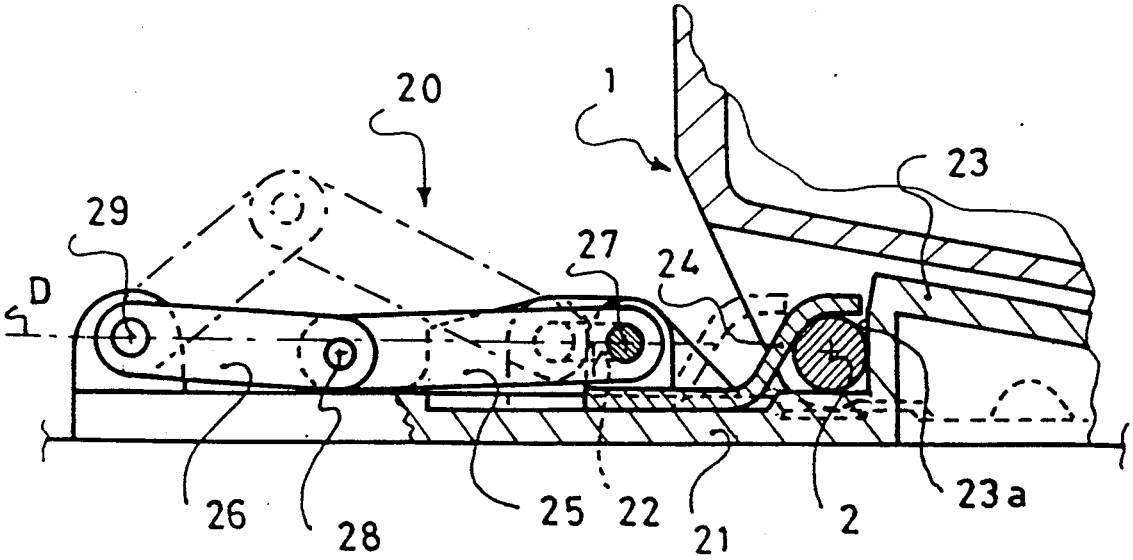
FIG. 3 is a side view in partial section of a binding according to a second embodiment.

FIG. 3 shows a binding 20, according to another embodiment, for which similar elements will be designated by the same reference numerals increased by 10, with respect to the binding of FIG. 2.

Binding 20 thus comprises, as does binding 10, base 21 having fixed support surface 23*a*, overcenter linkage system 25, 26, movable jaw 24, which is only displaceable longitudinally and being guided on each side by a slot 22 provided in the base.

The embodiment of the binding shown in FIG. 2 is more specifically adapted for a boot whose journal axle 2 is situated below the sole.

Fixed jaw 23 is simply formed by a substantially vertical planar surface 23*a* of a guidance rib affixed to the ski, and movable jaw 24 is in the shape of a hook.

The overcenter linkage includes two small links 25, 26 which are journalled together at 28. An unlatching lever can be added to journal axis 28 of the links to control the lifting thereof so as to unlock the linkage.

Binding 20 operates substantially the same as the binding of FIG. 2. The movement from the unlatched position, shown in chain-dotted lines, to the latched position occurs by rotation in the counterclockwise direction of the unlatching lever and by link 25 about axis 27. The locking of the overcenter linkage occurs as soon as axis 28 passes below the dead center line D. Conversely, unlatching occurs by rotation of lever 25 in the clockwise direction until axis 28 passes above line D. The lifting of axis 28 is facilitated by an additional actuation lever (not shown).

Figure 4:
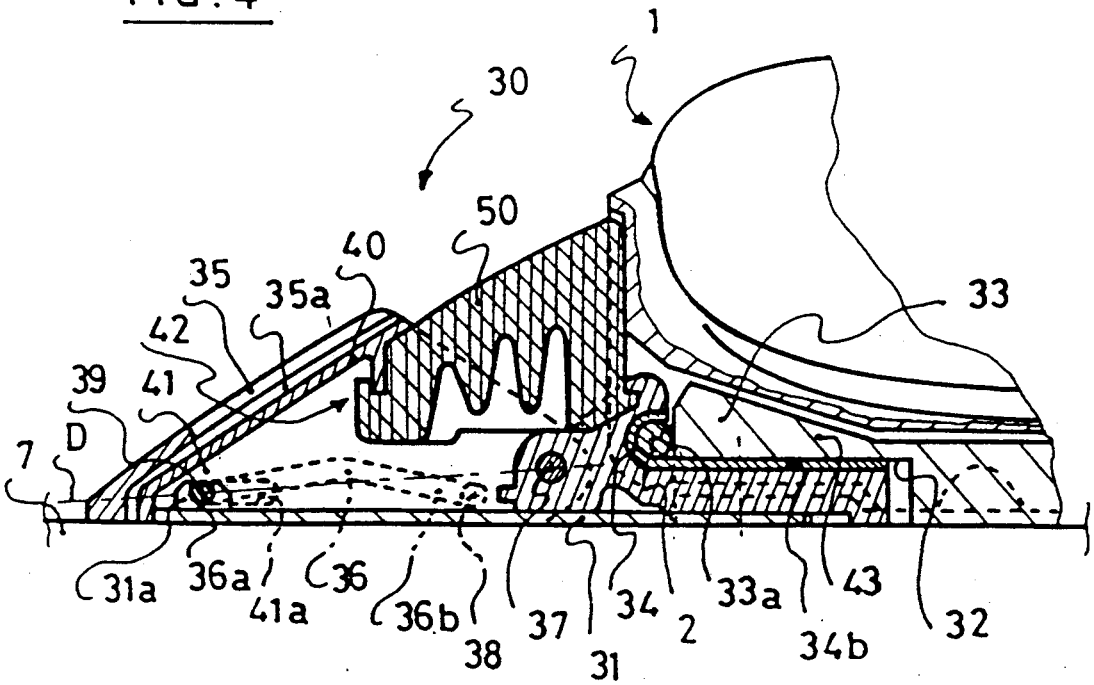
FIGS. 4 and 5 are longitudinal section views of a binding according to a third embodiment, in the closed and open positions, respectively.
Figure 5:
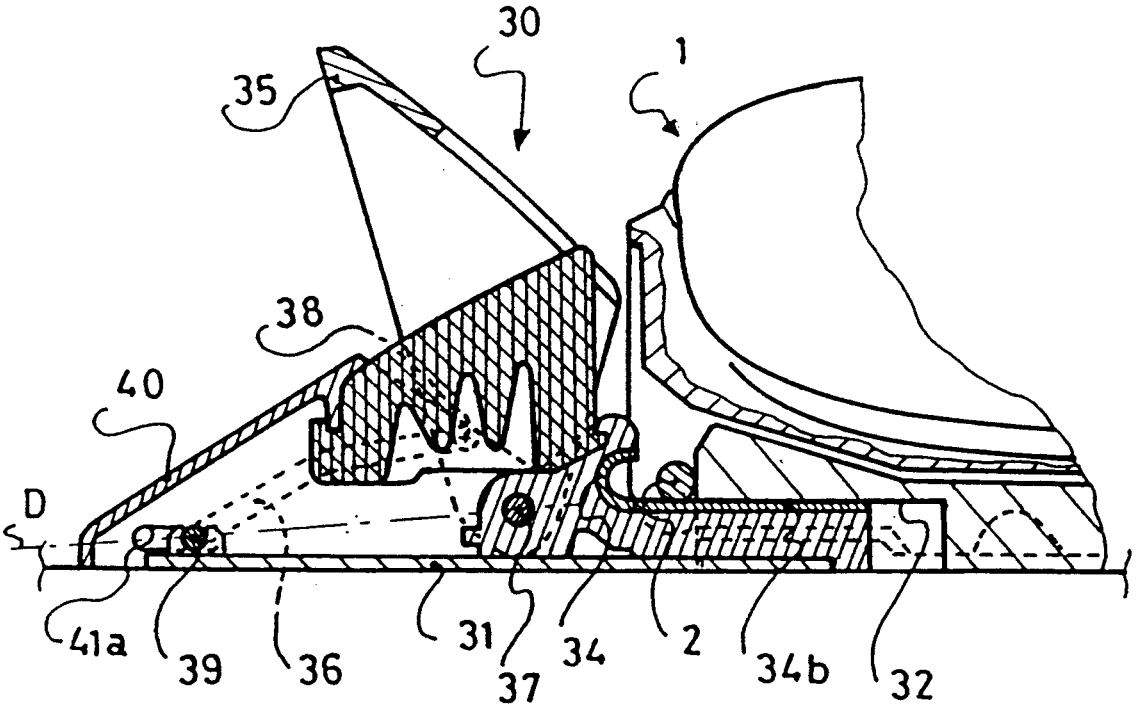

FIGS. 4 and 5 show another embodiment of binding 30 according to the invention in which the similar elements are designated by the same reference numerals, increased by 20 with respect to the binding of FIG. 2.

Binding 30 is, as is binding 20, adapted to latch a boot whose journal axle 2 is below the sole.

This binding includes base 31 affixed to the upper surface of the ski and having at its front end (i.e. on the left in the drawing), two projections 31*a* defining a housing for journal axis 39 of elastic mounting 36 of latching lever 35.

Elastic mounting 36, which is formed by a U-shaped stirrup of spring wire, is journalled, on the one hand at 39 on base 31, by its transverse arm 36*a*, and on the other hand at 38, on latching lever 35, by the ends of each of its laterally spaced legs 36*b*.

Fixed jaw 33 includes support surface 33*a* which is a substantially vertical planar surface of guidance rib 43. Movable jaw 34 is supported by carriage 40 which is displaceable with respect to base 31 and includes two wings 41 which are arranged on both sides of the base.

Movable jaw 34 is guided by groove 32, provided in guidance rib 43 which cooperates with associated extension 34*b* of movable jaw 34, and carriage 40 is itself guided in the longitudinal direction by horizontal slots 41*a* which are provided in each of its wings 41 for receiving transverse arm 36*a* of elastic mounting 36. Guidance of the carriage 40-jaw 34 assembly is thus carried out on each of the front and rear ends of the assembly, and is therefore particularly reliable. Furthermore, the guidance of carriage 40 by transverse arm 36*a* of elastic mounting 36 does not use additional elements since it uses a necessary element of the overcenter linkage, which therefore simplifies the construction.

Carriage 40 also includes housing 42 for elastic bumper 50 which is adapted to bias the nose of boot 1 during its pivotal movement about journal axle 2.

Latching lever 35 includes two lateral arms 35*a* which extend on both sides of movable carriage 40, and is journalled on carriage 40 by each of its arms 35*a* for movement about axis 37. Lever 35 is also journalled on base 31, as previously indicated, by elastic mounting 36. Lever assembly 35, elastic mounting 36 and jaw 34 define, as in the other bindings described, an overcenter linkage system whose three axes are constituted by journal axes 39, 38, 37, and whose dead center line D is that connecting the axes 39 and 37. Elastic mounting 36 can have a slightly arched shape as shown in FIGS. 4 and 5 to increase the latching force or it may be straight.

The operation of this binding is the same as that of the bindings previously described.

Closure of binding 30 occurs, from the open position shown in FIG. 5, by pivoting lever 35 about axis 37 in the counterclockwise direction. This pivoting simultaneously causes the lowering of axis 38 below dead center line D, and thus the latching of the system and the displacement of carriage 40, and thus movable jaw 34, towards the right of FIGS. 4 and 5. Axis 39 slides in slots 41*a* of carriage 40.

Conversely, unlatching occurs by rotation of lever 35 in the clockwise direction about axis 37. This rotation is accompanied by displacement of carriage 40 and of movable jaw 34 towards the left in the drawing (see FIG. 5).

It is noted that the invention makes it possible to enormously improve the guidance of the latching lever since the lever is guided by the movable jaw on which it is journalled. The longitudinal displacement of the movable jaw likewise makes it possible to position an elastic bumper on the movable jaw to exert a return force on the nose of the boot.

In the binding, according to the invention, a significant space is possible between the fixed jaw and the movable jaw for the insertion of the journal axle of the boot and any placement problem of the lever is also avoided.

Of course, the present invention is not only limited to the embodiments described above by way of non-limiting examples, but extends to all equivalents within the scope of the claims.

It is noted, for example, that the term "jaw", used for the fixed support part of the journal axle of the boot, is not limiting, and encompasses any support surface or fixed abutment for this axle which cooperates with an associated movable element.

We claim:

1. A cross-country ski binding for a shoe or boot having a transverse axle to allow pivoting of said shoe or boot relative to a fixed part of said binding, said binding comprising a fixed jaw and a movable jaw adapted to latch the axle while allowing rotation thereof, said movable jaw being displaceable in the direction of the fixed jaw, for the securing of said axle, a latching lever journalled for movement about an axis on said movable jaw, said latching lever and said axis forming an overcenter linkage system, further including guidance means for said movable jaw, a longitudinally displaceable carriage, said movable jaw and said guidance means being secured to said carriage, said guidance means including at least one longitudinal slot on said carriage and an axle on said fixed part of the binding which cooperates with said at least one longitudinal slot, said axle on said fixed part of the binding being one of the axes of said overcenter linkage system.

2. The binding according to claim 1, said axis on said movable jaw being a point defining a dead center line of the overcenter linkage system.

3. The binding according to claim 1, wherein said overcenter linkage system comprises a lever connected at one end to a fixed portion of the binding and at the other end to said latching lever, the connection to said fixed portion of the binding and said connection of said latching lever to said movable jaw defining a dead center line of said overcenter linkage system.

4. The binding according to claim 1, wherein said movable jaw is only displaceable in the longitudinal direction.

5. The binding according to claim 4, wherein said movable jaw cooperates with said fixed jaw for guidance in the longitudinal direction.

6. The binding according to claim 5, wherein said fixed jaw includes a groove and said movable jaw includes an extension for cooperating with said groove for the guidance in the longitudinal direction.

7. The binding according to claim 4, further comprising an elastic element mounted on and movable with said movable jaw adapted to contact the boot to exert a return force on the nose of the boot when the boot is lifted from the upper surface of the ski, and when the movable jaw is in a latched position.

8. The binding according to claim 1, further comprising biasing means for biasing said movable jaw in the direction of said fixed jaw.

9. A cross country ski binding for a shoe or boot having a transverse axle, said binding comprising (a) a base;

(b) a fixed jaw (c) a movable jaw being displaceable relative to said base towards said fixed jaw to a latched position and away from said fixed jaw to an unlatched position, said fixed jaw and said movable jaw being adapted to secure the transverse axle in the latched position;

(d) a latching lever for displacing said movable jaw;

(e) an overcenter linkage connected at a first end to said base and at a second end to aid latching leer; and (f) a movable carriage being movable in relation to said base, aid movable jaw being supported on said carriage slots on said movable carriage for cooperating with said overcenter linkage for guiding said carriage in the longitudinal direction.

10. A cross county ski binding for a shoe or boot having a transverse axle to allow pivoting of said shoe or boot, said binding comprising:

(a) a base;

(b) a fixed jaw;

(c) a movable jaw being displaceable relative to said base towards said fixed jaw to a latched position and away from said fixed jaw to an unlatched position, said fixed jaw and said movable jaw being adapted to secure the transverse axle in the latched position;

(d) a latching lever for displacing said movable jaw, said latching lever being pivotally connected to said movable jaw at a first joint;

(e) an overcenter linkage connected at a first end to said base and at a second end to said latching leer, said first end of said overcenter linkage being connected to said base at a second joint, and a line between said first joint and second joint defining a dead center line of said overcenter linkage; and (f) an elastic element being mounted on and movable with said movable jaw adapted to contact the shoe or boot to exert a return force on the nose of the shoe or boot when the shoe or boot pivots away from the upper surface of the ski, and when the movable jaw is in a latched position.

* * * * *